US005294019A

United States Patent [19]

Looker

[11] Patent Number: 5,294,019

[45] Date of Patent: Mar. 15, 1994

[54] PLASTIC SHEET ATTACHMENT

[75] Inventor: Robert Looker, Carpinteria, Calif.

[73] Assignee: Satco, Inc., El Segundo, Calif.

[21] Appl. No.: 964,399

[22] Filed: Oct. 21, 1992

Related U.S. Application Data

[60] Division of Ser. No. 703,696, May 20, 1991, Pat. No. 5,180,078, which is a continuation of Ser. No. 527,042, May 22, 1990, abandoned.

[51] Int. Cl.[5] ..... B65D 7/32

[52] U.S. Cl. ..... 220/683; 220/665; 220/401; 220/693

[58] Field of Search ..... 220/692, 693, 665, 401, 220/683

[56] References Cited

U.S. PATENT DOCUMENTS

| | | | |
|---|---|---|---|
| 1,019,255 | 3/1912 | Ickes | 220/693 |
| 1,402,949 | 1/1922 | Nichols et al. | 220/693 |
| 1,875,666 | 9/1932 | Schwemlein . | |
| 1,905,413 | 4/1933 | Kramer | 220/693 |
| 2,159,346 | 5/1939 | Welch et al. . | |
| 2,632,785 | 4/1953 | Gross | 220/693 |
| 2,723,048 | 11/1955 | Welch | 220/693 |
| 2,915,152 | 12/1959 | Graham | 220/693 |
| 2,925,193 | 2/1960 | Gibb | 220/693 |
| 2,989,226 | 6/1961 | Swartz . | |
| 3,227,736 | 1/1966 | Beckerman . | |
| 3,677,433 | 7/1972 | Collins . | |
| 3,721,366 | 3/1973 | Battershall et al. . | |
| 3,912,111 | 10/1975 | Marengoni . | |
| 4,223,498 | 9/1980 | Ventrice . | |
| 4,620,815 | 11/1986 | Goetter . | |

*Primary Examiner*—Joseph Man-Fu Moy
*Attorney, Agent, or Firm*—Lyon & Lyon

[57] ABSTRACT

In order to be able to utilize polycarbonate sheet material as a structural (i.e., stress-bearing) component in an assembly comprising polycarbonate and metal components, as, for example, in a monocoque air cargo container wherein the polycarbonate sheet material is used as the "skin" of the structure, an attachment assembly is utilized to provide a rigid, stress-bearing joint without inducing crack-inducing high levels of localized stress on the polycarbonate sheet. The attachment assembly comprises a significant area of overlap between the polycarbonate and metal components, and an attachment strip which substantially covers the attachment area. Rivets or bolts are inserted through oversized holes in the metal, polycarbonate, attachment strip assembly and then torqued. The compressive forces exerted thereby create the rigid joint (even in an environment where the joint is subject to 180° F.± temperature cycling such that the different coefficients for thermal expansion for the polycarbonate vs. the metal become significant) but are spread over a sufficiently large area so as to avoid high, localized stress levels which would induce the polycarbonate to crack.

20 Claims, 2 Drawing Sheets

PLASTIC SHEET ATTACHMENT

This application is a division of U.S. patent application Ser. No. 07/703,696, filed May 20, 1991, now U.S. Pat. No. 5,180,078, which is a continuation of Ser. No. 07/527,042, filed May 22, 1990, now abandoned.

BACKGROUND

1. Field of Art

This invention pertains to a method and apparatus by which a metal structural element and a polycarbonate sheet are attached together under torque by means of an attachment strip. It is believed that the invention will find at least a first primary use in air cargo containers wherein polycarbonate sheets are used as the siding or "skin" of the containers and must withstand handling stresses, significant temperature cycling, and, in the event of rapid acceleration or deceleration of the aircraft, shifting cargo which can be thrown under great force against the sides of the container.

2. Prior Art

One of the oldest tasks known to man is how best to transport his possessions from one place to another. From the very first crude bags made of animal hide to the space shuttle, man has been engaged in a continuous attempt to develop means to transport cargo farther, faster, safer, cheaper and easier.

A relative newcomer in this millennia of transportation is the aircraft, and although relatively new, it is now a major player in transporting the property of man. More than any other form of transportation, however, air cargo transport demands that its componentry be not only strong, but lightweight, as additional poundage is more costly with air travel. Additionally, safety has its highest priority in the air, as flight is, even more than ocean travel, intolerant of man's foolishness.

Therefore, the transportation of cargo by air requires, like no other, that the often elusive goals of strength, light weight and safety be accomplished in a single structure. For the transportation of cargo by air, the industry has come to rely almost exclusively on the all-aluminum cargo container, which is first loaded with cargo and is then itself loaded onto the aircraft. This modern air cargo container is a monocoque structure, comprising a rigid frame to which a sheet material, generally referred to as the "skin", is attached to the "bones" of the frame. In these monocoque structures, the skin is load-carrying, sharing the stresses with the frame structure. The loads go from the frame to the skin or from the skin to the frame via their attachment means, which can be rivets, bolts, etc. In construction and at rest, the skin is usually stressed in shear (meaning along the plane of the sheet rather than perpendicular to it), as are the attachment means. At the attachment points the holes in the sheets and frame are formed as close to the diameter of the fasteners as is practical to make the structure as rigid as possible. Clearance between the holes and the fasteners creates "slop" between the parts and therefore reduces the rigidity of the structure as relative movement between the sheet and frame create a "loose," and therefore weak, assembly. The ideal fasteners completely fill the holes in the parts they bring together without "slop", as that creates a structure in which the sheets are stressed in shear when the frames are stressed as a single unit, and is therefore stronger.

In use, however, the air cargo container will also be subjected to hoop tension or stress (i.e., perpendicular to its plane) as when the skins must restrain moving cargo. This is, of course, one of the most important if not the most important function of an air cargo container—to keep its cargo from breaking through its skin and becoming a missile in the event of crash-generating deceleration forces on the aircraft or in the event of turbulence inducing either severe acceleration or deceleration forces. In those flight-threatening events during which accelerations or decelerations occur, the cargo moves against the skins of the container which are thusly stressed in hoop tension which is transferred to the frame, then to the floor locks, then to the floor of the aircraft and eventually to the airplane itself. Hence, the skin material of the container must be able to withstand both significant shear stress and hoop tension.

For obvious reasons, the ideal air cargo container is light in weight, low in cost and capable of withstanding not only the stress encountered inflight, but also the day-today rigors of service—i.e., cargo crates being thrown against the walls, being bumped and jostled—all without being damaged. The best prior art devices used aluminum frames and skins with the sections being riveted together to form a rigid assembly. Rivets were preferably used to eliminate the "slop" between rivet shanks and the holes formed for the rivets, as rivets are "holefilling" (i.e., expand to fill the hole). Containers so made give good useful service, as the structures are rigid, are reasonably light in weight and low in cost.

The main problems these all-aluminum devices encountered in service were with the aluminum skins as they are subject to denting and tearing. Rough use and sharp-cornered boxes take their toll on the skins and often produce tears and dents. When torn, the containers are not serviceable as they are no longer "airworthy" and must be taken out of service and patched before they can be used again. Furthermore, torn skins present a hazard to loading crews and the cargo as the sharp edges cut indiscriminately. The aluminum skins can be made more resistant to such damage by making them thicker and more resistant to tearing, but then weight increases and the cost of flying dead weight (i.e., other than the weight of the transported cargo) makes such use less desirable and eventually not acceptable beyond a certain level. Using higher strength aluminum to solve the problem is actually counterproductive, as the stronger alloys are more brittle and more readily damaged by tearing. Accordingly, there is a need in the art for an improved skin material for air cargo containers.

Polycarbonate sheet has many unique qualities making its use desirable in many industrial applications. It is transparent. It can be struck heavily without being dented, torn or broken. This is because of the material's very low modulus of elasticity; the energy from a potentially damage-inducing blow is absorbed by the sheet without damage as though it were a rubber diaphragm. Hence, polycarbonate plastic sheet would theoretically be an ideal replacement for the aluminum skins. Its transparency would allow the contents of the container to be viewed. It is light in weight, only slightly more costly than the aluminum alloys used and capable of accepting the rough rigors of service without being dented or torn, as it is much more resistant to tearing or denting than is aluminum of comparable thickness and weight. The polycarbonate has substantial drawbacks to its use, however, which until now rendered it not feasible for use as a structural element and certainly not as the skin in a monocoque structure such as an air cargo container.

One such drawback is its very high coefficient of thermal expansion, 0.000037 inches per inch per degree Fahrenheit. This compares to 0.000013 for aluminum or 0.0000063 for steel. If the monocoque structure, the air cargo container for example, must operate in the temperature range of −40° F. to +140° F., as occurs in the air cargo container's service environment (at 30,000 feet versus in the plane's fuselage, on the tarmac, in the hot, desert sun), a typical air cargo-sized panel which is 120 inches between rivet centers when the panel was manufactured at an ambient temperature of 50° F. will be 120.4 inches in length (120 inches×90° F. temperature differential×0.000037 coefficient) when the temperature is 140° F. and 119.6 inches in length when the temperature is −40° F. In contrast, the distance between rivet centers of the aluminum structure will be 120.14 inches at 140° F. and 119.86 at −40° F. as the coefficient of linear expansion for aluminum is far less. Thus, conventional wisdom has in the past dictated that in order for the polycarbonate sheet to be compatible within this type environment the holes would have to be oversized in diameter (or slotted) by 0.26 inches (120.4−120.14+119.86−119.6) on each side of the panel, allowing for a differential expansion between the polycarbonate sheet and the aluminum frame of 0.52 inches total.

The resultant structure would, however, be at a severe disadvantage compared to its all-aluminum counterpart. The looseness or "slop" of the fasteners in the holes would prevent the sheet and the frame from acting as a load-sharing single unit. Therefore air cargo containers using polycarbonate sheets and conventional attachment means would have to bear the shear loads in the frame alone, which would have to be made larger in order to be stronger, and would therefore be excessively heavy.

Another disadvantage of the polycarbonate which has heretofore prevented its use in air cargo containers is its very low bearing strength, 12,500 psi compared to 100,000 psi for the aluminum alloys used for air cargo container sheets. In other words, the polycarbonate is one-eighth as strong in bearing. To compensate, the polycarbonate skin would have to be attached to the frame at many more locations than is necessary with aluminum skins. This would mean higher costs for the fasteners and the labor for installation, in addition to the heavy, costly frame structures. The resultant structure would be too heavy and costly to compete with the all-aluminum container.

There has heretofore been yet another disadvantage to the polycarbonate's use on air cargo containers; namely, its susceptibility to stress-induced and crazing agent-induced cracking or crazing. When there are residual stresses in polycarbonate, the material is subject to cracking, particularly in the presence of "crazing agents". These include a variety of materials including hydrocarbons, jet fuel cleaning materials, etc., many of which are used near the air cargo containers. A cracked polycarbonate sheet is non-serviceworthy as once cracked, the cracks spread very easily. One crack and the part must be taken out of service. If the residual operational stresses are kept low, for example, under 2000 psi, and the materials are kept free of "crazing agents," the material is relatively free of this incipient cracking problem. As explained above, however, this creates a classic "Catch-22" situation in that an unstressed sheet would require such a heavy frame that the resultant container would be unuseable, whereas riveting the sheet to the frame so that the overall container is unitarily stressed creates a crack-inducing environment, as high stresses are created under the head of the rivet and against the inside of the hole by the expanding rivet shank.

Because of these disadvantages, the use of polycarbonate has heretofore been restricted to applications where it "floats" in its frame, as in signs and aircraft windows, and has not been used as a genuine structural component. For example, in the reference book published by the principal manufacturer of polycarbonate sheets, the means and methods displayed for attaching the sheets specify loosely torqued bolts in oversized holes with a silicone cushion. Certainly, polycarbonate sheet material has not heretofore proven to be an acceptable substitute for the aluminum "skin" on a monocoque airline cargo structure because no acceptable means for attaching the polycarbonate to the aluminum frame was known. Accordingly, there has existed a need in the art for a means for rigidly attaching polycarbonate sheet material to a metal structural element in a way to allow the polycarbonate to act as a structural component, while at the same eliminating or substantially alleviating the material's tendency to crack or craze under stress.

SUMMARY OF INVENTION

It has been discovered that by providing the novel attachment means of this invention, the polycarbonate can be attached to the metal structural elements in a non-slip manner which does not induce cracking or crazing of the polycarbonate. The means of attachment comprises having the polycarbonate sheet overlap the metal structural member by a substantial amount to create an attachment area. Rather than attaching the polycarbonate to the metal by conventional, interspaced bolts or rivets, the device of this invention uses an attachment strip which is essentially a u-shaped channel member having a width not substantially less than the width of the attachment area and which extends substantially the entire length of the attachment area. Conventional bolt or rivet means are used to attach this assembly together under sufficient torque to prevent slippage.

In an alternate embodiment intended for high-torque applications, the bolting strip is flexed slightly in the untorqued condition, the face of which is then brought flush against the polycarbonate sheet in the torqued condition.

This invention solves each of the aforementioned drawbacks which had previously prevented the use of polycarbonate sheets as a structural element; such as the skin in commercial air cargo containers. After the clamping bolts or rivets are torqued in place, the strength of the resultant assembly is the sum of the strength of the sheet in bearing and the friction induced by the clamping. The force of clamping is spread over a broad area, not just under the fastener (as under the washer of a bolted joint or under the rivet head in a riveted joint) such that the joint is protected from high incipient stress levels and consequent cracking due to crazing from stresses and crazing agents. Also, because the large attachment strip spreads the attachment force over a large area and hence provides sufficient friction, the holes through which the bolts or rivets are inserted in the sheets can be over-sized so as eliminate the possibility of creating excessively high localized stress levels within the hole itself. Being rigidly clamped to the frame by the attachment strip, however, the assembly still works as a single unit sharing the stresses, as does the riveted all-aluminum structure, wherein the sheets are stressed in shear and hoop tension and the frame in bearing. As the strength due to friction is substantial, fewer fasteners are required for the clamping system than for an exactly comparable all-aluminum structure, therefore reducing the costs of assembly.

It has also been found that the use of this invention also overcomes the drawback inherent in the great difference between the coefficient of thermal expansion of the polycarbonate sheet and the aluminum frame. Specifically, it was found that the high clamping forces achieved with this invention hold the polycarbonate sheet so tightly in the frame that when the temperature is reduced the sheets do not shorten. Instead, as the temperature drops, the sheets pull inwardly, but the clamps are sufficiently tight to prevent slippage and the sheets become stretched tightly in the frame structure as a head of a drum and the sheet thickness actually gets thinner rather than the overall length of the sheet becoming shorter. The low elastic modulus of the the polycarbonate permits the tightening of the sheet in the frame without pulling loose from the clamped assembly of this invention.

Highly torqued bolts are required to clamp the polycarbonate sheets to the frames in certain structures to overcome stress due to heavy handling or extreme temperature cycling. Although there is clearance between the bolt shanks and holes in the polycarbonate sheet (to avoid high localized stress) there is no "slop" in the structure; the high friction forces make the assembly act as a unit which permits a lighter and less costly frame structure acceptable for air cargo use.

In sum, it is now possible for the first time to use polycarbonate as a structural material in a monocoque structure, rigidly attaching it to the metal frame and thereby loading it in both shear and hoop tension and using all of the benefits the material offers, without subjecting the structures to the dangers of cracking due to the residual stresses and crazing agents, and still having a container that exhibits the strength and lightweight of its all-aluminum counterpart. The novel attachment means by which this is accomplished and the novel air cargo container utilizing polycarbonate sheet as a structural component are described and depicted hereinafter in detail.

DESCRIPTION OF THE PREFERRED EMBODIMENT

Figure 1:
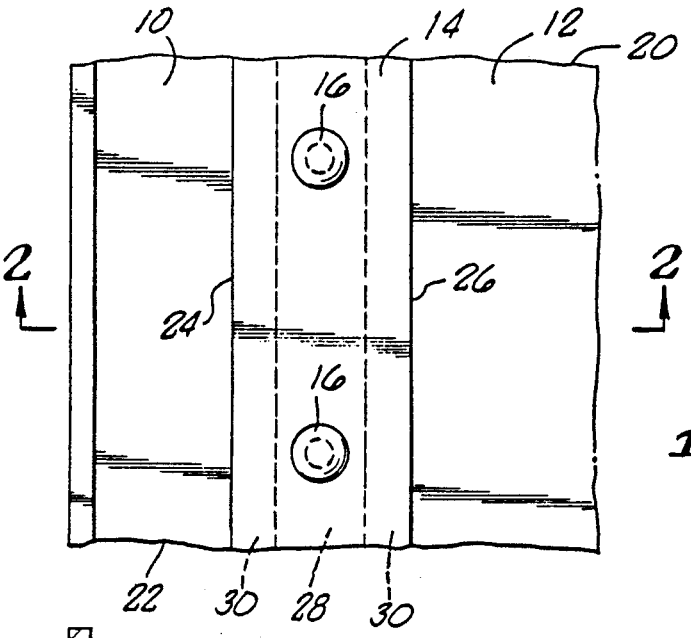
FIG. 1 is a plan view showing the polycarbonate sheet assembled to the metal structural member.

Referring to FIG. 1, the components of the attachment means are the structural metal member 10 (it can be either steel or aluminum preferably); the polycarbonate sheet 12; the attachment strip 14 (preferably of the same material as the member 10); and the rivets or bolts 16, which are inserted through approximately-sized (so as to avoid intrahole stress) holes 18.

Figure 2:
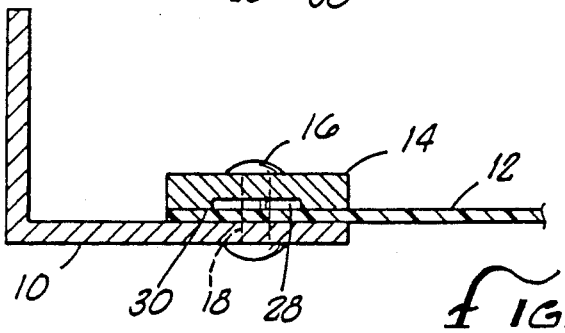
FIG. 2 is a cross-section, taken along line 2—2 in FIGS. 1 and 5 showing the polycarbonate sheet "sandwiched" between the metal structural member and the attachment. Here, a rivet is shown rather than a conventional bolt.
Figure 3:
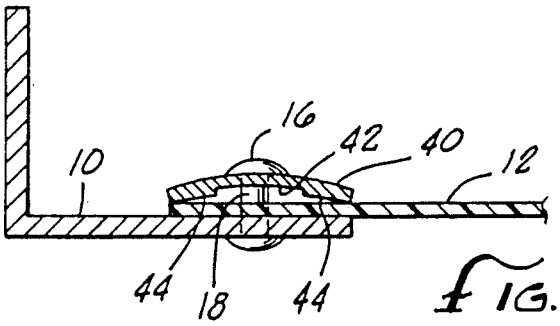
FIG. 3 is a similar cross-sectional view, showing the alternate embodiment of the bolting strip, here in the untorqued or flexed position.
Figure 4:
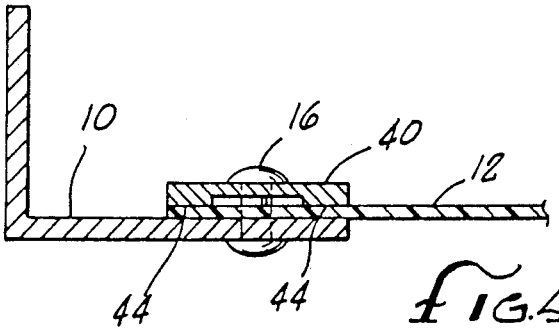
FIG. 4 shows the alternate embodiment of the bolting strip in FIG. 3, but in the torqued position. It is noted that in this condition, the cross-sectional view of the attachment strip is exactly the same as that shown in FIG. 2, except that it is thinner and therefore lighter in weight.

Looking at FIG. 2, the structural member 10 is commonly L-shaped and will have another polycarbonate sheet 10 (not shown) attached to its opposite side. In FIGS. 2 through 4, it is seen that in this assembly the polycarbonate panel 12 is caused to overlap a portion of the structural member 10, such that an attachment area (as defined in FIG. 1 by the area bounded on the top by line 20, on the bottom by line 22, on the left by line 24 and on the right by line 26) is created. It will be understood that FIG. 1 is "cut-away" on the top and bottom. The actual assembly extends for a considerable distance and the area of overlap and hence the attachment area will also continue for substantially the entire length of the polycarbonate sheet 12.

The first embodiment of the attachment strip 14 as shown in FIG. 2 is, in both the torqued and untorqued condition, planar on all major surfaces, and has a channel 28 formed centrally on the side adjacent to the polycarbonate sheet 12, such that legs 30 are created. The term "torqued" herein of course refers to the embodiment using bolts. In an embodiment using rivets, the analogous term should be understood to be "bucked" or "headed". This is provided to relieve and distribute the compressive stresses resulting from the torquing of the bolt or rivet 16. Instead on being concentrated under the bolt or rivet head, substantial contact areas are provided not only adjacent to the rivet, but also linearly therebetween. If the rivet 16 were attached directly to the polycarbonate sheet 12 (in other words, without the attachment strip 14), the compressive forces under the rivet head would extend outwardly to about $\frac{5}{8}$-inch in diameter. Taking into account the $\frac{1}{4}$-inch diameter hole 18, the entire compressive force would therefore be concentrated upon approximately 2.58 square inches of the polycarbonate sheet. If the bolt 16 is tightened to a torque of approximately 48 inch-pounds (which is typical with some air cargo containers), the resultant force on the polycarbonate sheet is 2,976 pounds per square inch. This amount of stress is very prone to cause crazing. If, using this invention on the other hand, the legs 30 of the attachment strip 14 are each $\frac{3}{8}$-inch wide, and the bolts 16 are affixed on $2\frac{1}{2}$-inch centers, the effective area under compression for each bolt 16 is approximately 1.875 square inches which results in a stress of 410 pounds per square inch. This amount of stress does not promote crazing. In fact, the torque on the bolts 16 could be increased to 96 inch-pounds which, with the attachment means here described, would result only in 622 pounds per square inch of stress on the polycarbonate sheet 12. There would not be a danger of crazing at this stress level since polycarbonate is susceptible to crazing in the presence of crazing agents at stress levels over 1,000 per square inch tension or compression.

In FIGS. 3 and 4, the alternate embodiment of the attachment strip is depicted in cross-section. Here, the strip is preformed in a flexed or concave shape. As in the previously embodiment, a central channel 42 is formed on its underside to create legs 44. The torque forces pressing downward on the upper portion of the strip 40 will cause it to straighten, bringing legs 44 flush against the sheet 12, and accordingly provide uniform compression loads over the entire attachment area, as shown in FIG. 4. This alternate embodiment is used when the torque loads are high and the strips are made thin to save cost and weight. If the higher torque loads were applied to a thin, flat strip, there is danger of stress concentration on the inner edges of channel 42. This stress concentration could provide an uneven load on the polycarbonate sheet, thereby subjecting the sheet at certain points to increased stress and a possibility of crazing failure. It will be appreciated that with this invention the amount of torqued applied to the rivet should be closely controlled. The size of hole 18 should be sufficiently large, and the torque on the bolt sufficiently low to prevent intra-hole hole stress.

Figure 5:
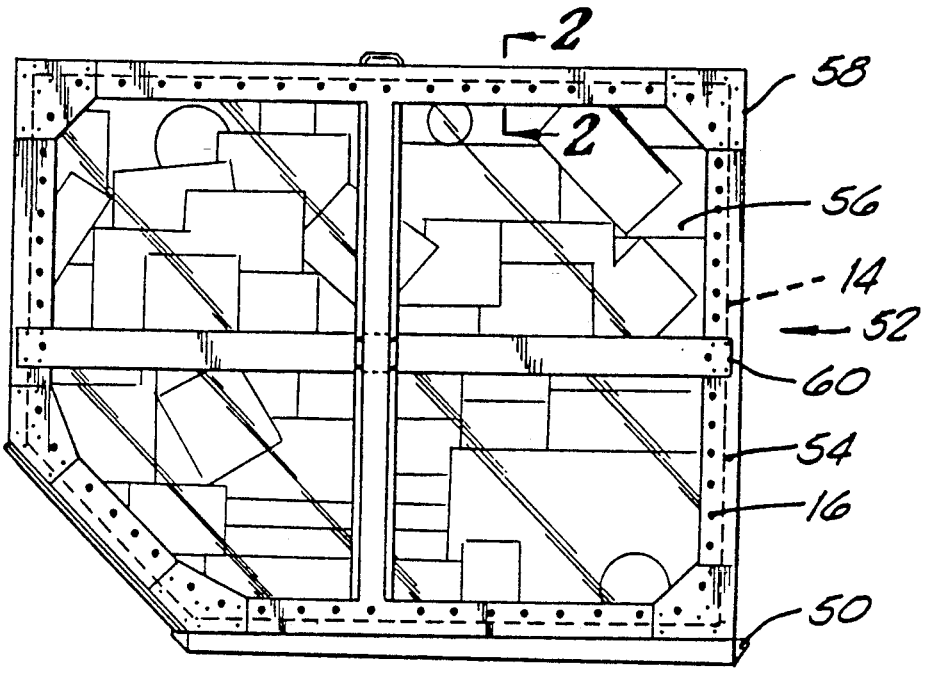
FIG. 5 shows an air cargo container in which polycarbonate sheets are rigidly attached as the skin and as a structural component using the attachment strip assembly depicted in FIGS. 1 and 2.

As mentioned, it is believed that the use of the attachment strip assembly previously described will find a first utility in monocoque air cargo containers, such as that shown in side view in FIG. 5. It comprises the metal (preferably aluminum) base 50, to which a frame 52 of metal (preferably aluminum) structural members 54 are attached by conventional rivet, bolt or welding means (not shown), and to which the polycarbonate sheets 56 are attached using the assembly described and shown above. The attachment strip 14 is shown in shadow. A door (not shown) is provided in the front panel section of the container. As can be seen, the packages in the container are visible through the polycarbonate sheet. Corner gussets 58 and cross-members 60 are added for strength and stability.

Although specific embodiments of this invention have been set forth above, it should be apparent to those skilled in the art that other modifications upon those embodiments would be possible without departing from the inventive concepts hereinafter claimed. Accordingly, this patent and the protection provided by it are not limited to the specific embodiments set forth above, but are of the full breath and scope of each of the appended claims or their equivalence.

I claim:

1. An assembly comprising a metal structural member to which a polycarbonate sheet is attached by attachment means, said attachment means comprising:

a) said polycarbonate sheet overlapping said structural member along substantially the entire length of the polycarbonate sheet to create an attachment area;

b) an attachment strip having a width substantially the same as the width of said attachment area, and having a length substantially the same as the length of said attachment area;

c) said attachment strip having a channel formed therein on the side adjacent said polycarbonate sheet; and d) fasteners passing through said structural member, polycarbonate sheet and attachment strip for holding those elements rigidly together.

2. The invention of claim 1 wherein the side of said attachment strip adjacent to the polycarbonate sheet is substantially planar in the untorqued condition.

3. The invention of claim 1 wherein said attachment strip is preformed in a flexed, concave shape on the side adjacent to the polycarbonate sheet, such that under compression it is brought flush against the polycarbonate sheet.

4. The invention of claim 1 wherein said polycarbonate sheet overlaps said structural member by approximately 1¼ inches.

5. The invention of claim 1 wherein said attachment strip has a width of approximately 1¼ inches.

6. The invention of claim 1 wherein said channel is centrally located and sufficiently wide so as to leave approximately a ⅜ inch wide area on either side thereof in contact with said polycarbonate sheet.

7. The invention of claim 1 wherein said fasteners are spaced apart on approximately 2½ inch centers and located centrally relative to said channel in said attachment strip, which is centrally formed therein.

8. The invention of claim 1 in which said fasteners are bolts attached with a torque not in excess of 100 inch-pounds.

9. The invention of claim 1 wherein said attachment strip is metal, and said polycarbonate sheet has clearance holes for the fasteners which are sufficiently larger than the fastener such that no intra-hole stress is exerted on said polycarbonate sheet by the fasteners.

10. An assembly comprising a metal structural member to which a polycarbonate sheet is attached by attachment means, said attachment means comprising:

a) said polycarbonate sheet overlapping said structural member such that the area of overlap is approximately 1¼ inches along substantially the entire length of said polycarbonate sheet;

b) an attachment strip having substantially the same length and width as said area of overlap;

c) said attachment strip having a channel formed in one side thereof adjacent said polycarbonate strip such that as assembled the entire side of said attachment strip will not be in contact with said polycarbonate sheet, and only an area approximately ⅜ inch wide and being the same length as said attachment strip on either side of said channel will contact said polycarbonate sheet; and d) bolts on approximately 2½ inch centers inserted through apertures in said structural member, said polycarbonate sheet and said attachment strip and torqued to not more than 100 inch-pounds.

11. The invention of claim 10 wherein the side of said attachment strip adjacent to the polycarbonate sheet is substantially planar in the untorqued condition.

12. The invention of claim 10 wherein said attachment strip is preformed in a flexed, concave shape on the side adjacent to the polycarbonate sheet, such that under torque it is brought flush against the polycarbonate sheet.

13. The invention of claim 10 wherein said attachment strip is metal.

14. A method for attaching a polycarbonate sheet to a metal structural member comprising the steps of:

a) overlapping said polycarbonate sheet onto said structural member such that an attachment area is formed;

b) placing an attachment strip having a length and width approximately equal to that of said attachment area against the attachment area, said attachment strip having a channel formed therein on the side adjacent said polycarbonate sheet such that only a portion on the outer edges of said strip come into contact with said sheet;

c) installing fasteners into spaced and aligned holes through the assembly of said metal structural member, said polycarbonate sheet and said attachment strip; and d) tightening the fasteners to create a non-slip union between said member and said sheet.

15. The method of claim 14 further including the step of creating attachment area to have a width greater than 1 inch and a length substantially the same as the length of said polycarbonate sheet.

16. The method of claim 14 further including the step of placing said attachment strip such that it covers substantially the entire attachment area.

17. The method of claim 14 further including the step of placing said holes not less than 1 inch nor more than 4 inches apart.

18. The method of claim 14 further including the step of tightening the fasteners to not less than 30 inch pounds nor more than 100 inch pounds of torque.

19. The method of claim 14 wherein the fasteners are bolts.

20. The method of claim 15 wherein the fasteners are rivets.

* * * * *